US008852006B2

(12) United States Patent
Gnezdilov

(10) Patent No.: US 8,852,006 B2
(45) Date of Patent: Oct. 7, 2014

(54) OBSERVATION WHEEL

(76) Inventor: Vladimir Alexeevich Gnezdilov, Moscow (RU)

( * ) Notice: Subject to any disclaimer, the term of this patent is extended or adjusted under 35 U.S.C. 154(b) by 0 days.

(21) Appl. No.: 13/701,258

(22) PCT Filed: Sep. 8, 2011

(86) PCT No.: PCT/RU2011/000688
§ 371 (c)(1),
(2), (4) Date: Nov. 30, 2012

(87) PCT Pub. No.: WO2012/011852
PCT Pub. Date: Jan. 26, 2012

(65) Prior Publication Data
US 2013/0095936 A1 Apr. 18, 2013

(30) Foreign Application Priority Data
Jul. 8, 2010 (RU) ..... 2010128213

(51) Int. Cl.
*A63G 27/00* (2006.01)
*A63G 9/00* (2006.01)

(52) U.S. Cl.
CPC ..... *A63G 27/00* (2013.01)
USPC ..... 472/45

(58) Field of Classification Search
USPC ..... 472/29, 30, 44, 45, 136
See application file for complete search history.

(56) References Cited

U.S. PATENT DOCUMENTS

| | | | | | |
|---|---|---|---|---|---|
| 535,362 | A | * | 3/1895 | De Vore | 472/45 |
| 809,937 | A | | 1/1906 | Friede | |
| 899,286 | A | | 9/1908 | Biavati | |
| 2,320,555 | A | | 6/1943 | Bartlett | |
| 3,226,113 | A | * | 12/1965 | Mercer et al. | 472/3 |
| 3,456,943 | A | * | 7/1969 | Brown | 472/3 |
| 3,552,747 | A | * | 1/1971 | Deem | 472/3 |
| 4,815,728 | A | | 3/1989 | O'Keefe | |

* cited by examiner

*Primary Examiner* — Kien Nguyen
(74) *Attorney, Agent, or Firm* — Galgano & Associates, PLLC; Thomas M. Galgano; Jessica G. Bower

(57) ABSTRACT

The observation wheel is the arrangement of passenger modules in groups with a distance between the groups circumferentially which exceeds the distance circumferentially between the passenger modules in the groups. An outer annular element is reinforced in the areas in which the groups are arranged.

6 Claims, 2 Drawing Sheets

OBSERVATION WHEEL

FIELD OF THE INVENTION

The present invention relates to the amusement industry.

DESCRIPTION OF THE PRIOR ART

It has formerly been proposed an observation wheel comprising passenger units mounted on an outer ring-shaped element of the load-bearing structure provided with radial members (see the RF patent No. 2211070 dtd. 18 Jan., 2002).

The disadvantage of the known device is considerable metal consumption resulting from unpractical and inefficient arrangement of passenger units (gondolas) along the outer ring-shaped element of the load-bearing structure and from use of a great number of radial elements. Presence of a large number of radial members causes an increase in wind load acting on an observation wheel structure.

SUMMARY OF THE INVENTION

The embodiments of the present invention are aimed to remove the said disadvantage by providing an optimal ratio between the number of passenger units and radial elements.

The said objective is accomplished through a special arrangement of passenger units in the observation wheel which suggests that in said observation wheel comprising passenger units fixed on the outer ring-shaped element of the load-bearing structure provided with radial members said passenger units are arranged in groups the circumferential distances between which exceed those between the passenger units within the groups, and at the same time said outer ring-shaped element is reinforced in the areas of the groups location.

Groups can include at least two passenger units.

In the first modification of the observation wheel groups of passenger units or parts thereof are arranged within the areas of connection of radial members to the outer ring-shaped element, and in the second modification groups of passenger units or parts thereof are arranged between the areas of connection of radial members to the outer ring-shaped element.

Groups of passenger units may include both open and closed gondolas.

LIST OF THE DRAWINGS

Essence of the invention is illustrated by the appended drawings in which.

DESCRIPTION OF THE PREFERRED EMBODIMENTS

Figure 1:
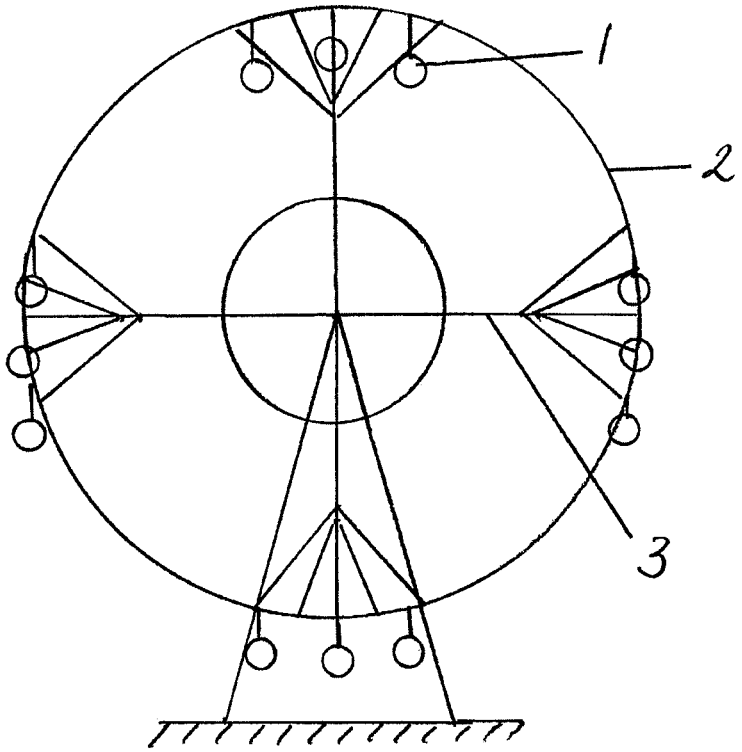
FIG. 1 is a view of the first modification of the panoramic wheel.
Figure 2:
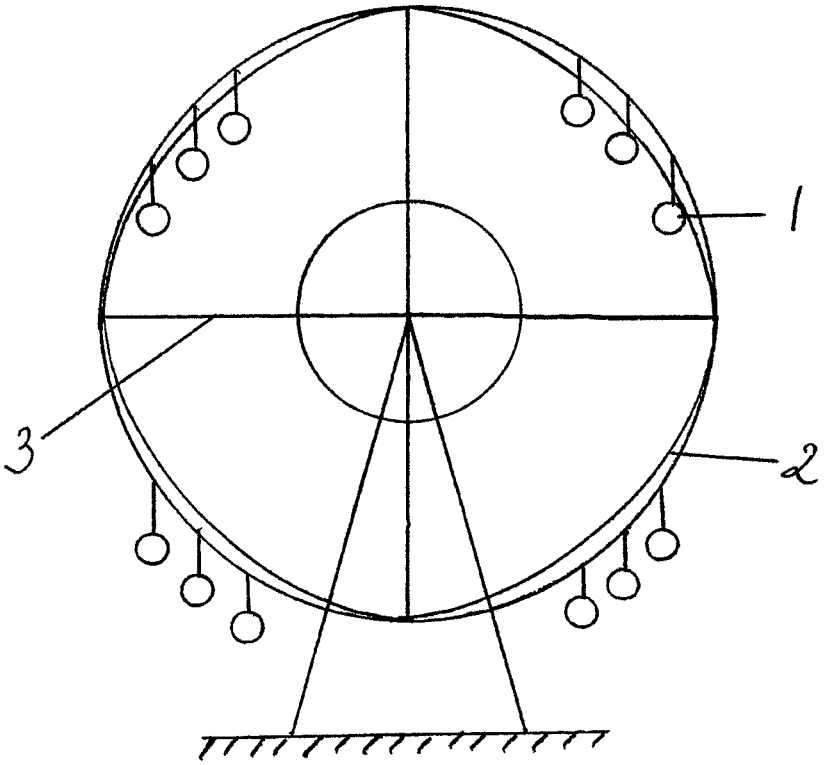
FIG. 2 is a view of the second modification of the panoramic wheel.

The observation wheel comprises passenger units (gondolas) 1 which are fixed on the outer ring-shaped element 2 of the load-bearing structure provided with radial members 3. The passenger units 1 are arranged in groups the circumferential distances between which exceed those between the passenger units within the groups. The number of passenger units in each group is determined by the diameter of the load-bearing structure and required throughput of the observation wheel.

In the areas of said groups of passenger units location the outer ring-shaped element is provided with reinforcement made, for example, with increase of the section stiffness toward its center. When passenger units are located within the area of connection of a radial member to the outer ring-shaped element the reinforcement of the said ring-shaped element can be implemented through execution of the connection by structural means.

The said observation wheel operates similarly to the known observation wheels.

What is claimed is:

1. An observation wheel, comprising:

a load-bearing structure comprising an outer ring-shaped element having a center and an outer peripheral edge, and a plurality of radial members extending radially outwardly from said center of said outer ring-shaped element to said outer peripheral edge of said outer ring-shaped element;

a plurality of passenger units all of which are fixed to said outer peripheral edge of the same outer ring-shaped element of said load-bearing structure, wherein said passenger units are arranged in a plurality of groups along said outer peripheral edge of the same outer ring-shaped element, wherein the circumferential distances between said groups of passenger units within the same outer ring-shaped element exceeds the circumferential distances between said passenger units within said groups, and wherein said outer ring-shaped element is reinforced in areas of said groups.

2. The observation wheel according to claim 1, wherein: said groups comprise at least two passenger units.

3. The observation wheel according to claim 1, wherein: at least a portion of said groups of passenger units are located within said areas of connection of said radial members to said outer ring-shaped element.

4. The observation wheel according to claim 1, wherein: at least a portion of said groups of passenger units are located between said areas of connection of said radial members to said outer ring-shaped element.

5. The observation wheel according to claim 1, wherein: said groups of passenger units comprise a member selected from the group consisting of open gondolas and closed gondolas.

6. The observation wheel according to claim 1, wherein: said load-bearing structure comprises a single outer ring-shaped element.

* * * * *